United States Patent [19]

Coffee

[11] 4,401,274

[45] * Aug. 30, 1983

[54] CONTAINERS FOR USE IN ELECTROSTATIC SPRAYING

[75] Inventor: Ronald A. Coffee, Haslemere, England

[73] Assignee: Imperial Chemical Industries PLC, London, England

[ * ] Notice: The portion of the term of this patent subsequent to Jun. 24, 1997 has been disclaimed.

[21] Appl. No.: 240,287

[22] Filed: Mar. 4, 1981

[30] Foreign Application Priority Data

Mar. 20, 1980 [GB] United Kingdom ..... 8009490

[51] Int. Cl.[3] ..... B05B 5/02

[52] U.S. Cl. ..... 239/690; 239/377; 361/228; 361/235

[58] Field of Search ..... 239/690–708, 239/3, 377, 379; 361/228, 235

[56] References Cited

U.S. PATENT DOCUMENTS

| | | | |
|---|---|---|---|
| 4,165,022 | 8/1979 | Bentley et al. | 239/704 X |
| 4,209,134 | 6/1980 | Coffee | 239/690 |

FOREIGN PATENT DOCUMENTS

| | | | |
|---|---|---|---|
| 1071937 | 2/1980 | Canada | 239/690 |
| 1198480 | 7/1970 | United Kingdom | 239/690 |

*Primary Examiner*—Andres Kashnikow

*Attorney, Agent, or Firm*—Cushman, Darby & Cushman

[57] ABSTRACT

A liquid container adapted to form part of an electrostatic spraying apparatus and having attached to it a high voltage generator to supply the voltage required for the electrostatic spraying. The container and apparatus also include the electrical contacts necessary to connect the generator to an electrical power supply and to the electrostatic spraying apparatus.

6 Claims, 5 Drawing Figures

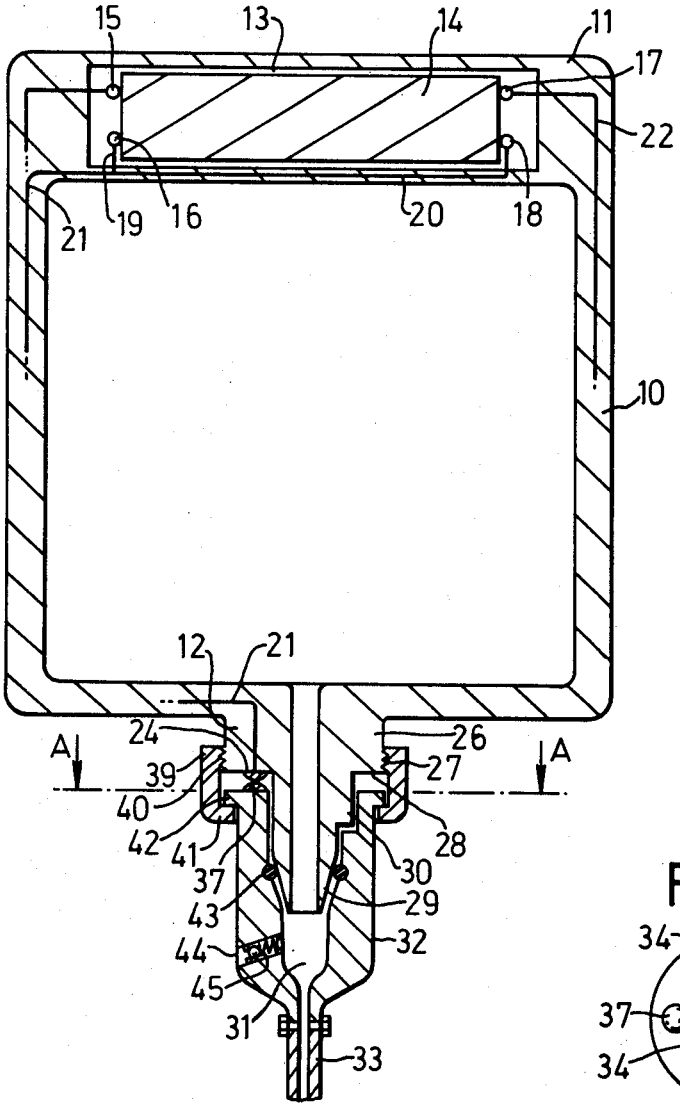
FIG. 1.
FIG. 2.
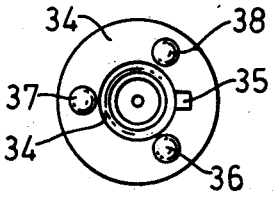

FIG. 5.
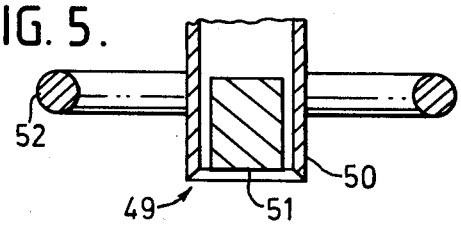
FIG. 3.
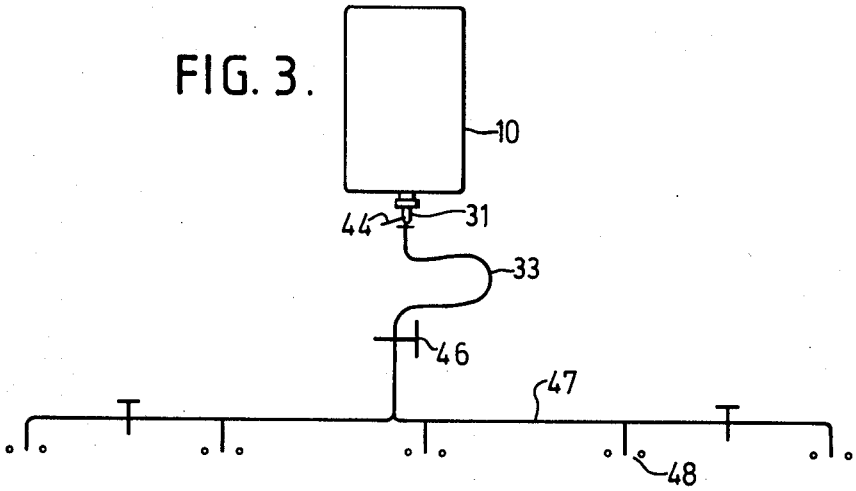
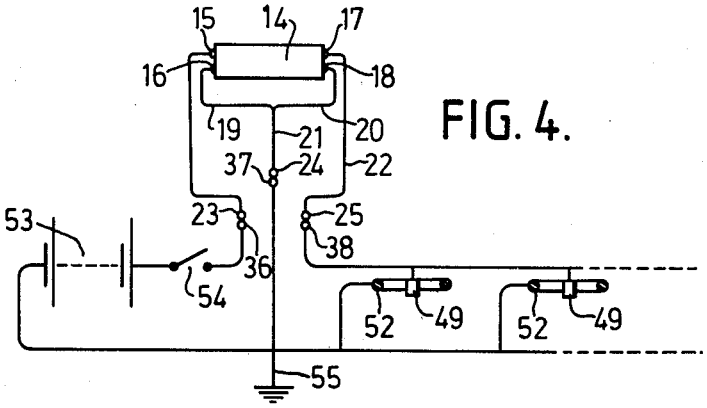
FIG. 4.

CONTAINERS FOR USE IN ELECTROSTATIC SPRAYING

This invention relates to electrostatic spraying operations, including in particular to containers for use in the electrostatic spraying of liquids.

In U.S. Pat. No. 4,356,528 there is described an apparatus for the electro-static spraying of liquids. This apparatus is of simple construction, with a low power requirement (it has no moving parts and can readily be run off dry cells); it is thus particularly suited for use as a hand held sprayer in applications where large power sources are not readily available: for example, in spraying crops. Electrostatic spraying of crops also has advantages in promoting even coating of plants, with spray being attracted around behind foilage instead of coating only exposed surfaces; and in reducing spray drift, which is at best wasteful and at worst hazardous to the environment.

The apparatus disclosed in U.S. Pat. No. 4,356,528 comprises essentially a discharge nozzle; an electrode disposed around the nozzle; a container for supplying liquid to be sprayed to the nozzle; and a high voltage generator for applying a high voltage to the nozzle, the electrode being earthed. In this way a strong electric field may be produced between the nozzle and the electrode, sufficient to atomise liquid passing through the nozzle.

This apparatus is particularly suitable for the application of pesticides at low or ultra-low volume typically at a spray application rate in the range 0.5 to 10 liters spray liquid per hectare). Low and ultra-low volume spraying have several recognized advantages, as well as being especially suitable where water is not readily available as a spray diluent, but they also have one disadvantage. Of necessity, they must use relatively concentrated pesticidal compositions. Such compositions frequently have a greater or lesser degree of human toxicity, and for this reason it is desirable that they should be handled as little as possible. A particular danger is the decantation of poisonous liquids into beverage bottles.

A pesticide sprayer, to provide the best service, must be reliable and adaptable. Desirably it should be able to spray pesticides of several different kinds. Different pesticides come in different formulations, having different electrical properties, and requiring to be sprayed in differing droplet sizes to give optimum effect. In the apparatus of our U.S. Pat. No. 4,356,528 useful and convenient control over droplet size and spraying properties can be provided by varying the applied voltage; but the size of the nozzle and the relative size and position of the surrounding electrode may also require adjustment to suit the formulation being sprayed. It is often difficult to do this reliably in the field. Also, the spray tanks of pesticide sprayers normally require careful cleaning between application of different pesticides; otherwise, for example, traces of herbicide may damage crops being sprayed against fungal attack. The need for such cleaning is increased when formulations are to be sprayed electrostatically, since contamination may affect their electrical properties.

In U.K. Pat. Nos. 2030060 and 2061769A there is described liquid containers suitable for use in electrostatic spraying apparatus of the kind described in U.S. Pat. No. 4,356,528 which enable a number of problems outlined above to be mitigated or overcome.

Broadly, U.K. Pat. Nos. 2030060 and 2061769A describe a liquid container adapted to form part of apparatus for electrostatic spraying, the apparatus including a power source, a high voltage generator, a spray nozzle at least part of the surface of which is electrically conductive, an electrode disposed adjacent the nozzle and insulated therefrom with electrical connections for connecting the power source to the input terminals of the generator, the electrode to one output terminal and the nozzle to the other output terminal of the generator; the container having an orifice for delivering liquid, mounting means for locating the container in the apparatus in a position in which the orifice can deliver liquid to the spray nozzle, the mounting means including a conductor or conductors completing said electrical connections.

The aforesaid UK applications also describe apparatus for electrostatic spraying as defined above, suitable for receiving a container according to the invention.

The present invention relates to containers of the type described in the aforesaid UK applications, and consists in a liquid container adapted to form part of such a system for electrostatic spraying, in which the high voltage generator is mounted on the container. Accordingly the present invention comprises a liquid container adapted to form part of apparatus for electrostatic spraying, the apparatus including a power supply, a high voltage generator, a spray nozzle at least part of the surface of which is electrically conductive, an electrode disposed adjacent the nozzle and insulated therefrom, with electrical connections for connecting the power supply to the input terminals of the generator, the electrode to one output terminal of the generator and the nozzle to the other output terminal of the generator; the container being formed so as to support and carry the generator, and having an orifice for delivering liquid, mounting means for locating the container in the apparatus in a position in which the orifice can deliver liquid to the spray nozzle, the mounting means including electrical contacts and conductors for completing said electrical connections to the generator terminals from the power supply, the nozzle and the electrode. The invention further comprises spraying apparatus suitable for receiving a container according to the invention which includes a spray nozzle, an electrode adjacent the nozzle and insulated therefrom, complementary mounting means for locating the container in the apparatus in a position in which the orifice can deliver liquid to the spray nozzle, and a power source for activating the generator; said complementary mounting means having electrical contacts complementary to the contacts of the container mounting means, for connecting the power supply to the generator input terminals, the nozzle to one generator output terminal and the electrode to the other generator output terminal.

Throughout this specification, the term 'conducting surface' is intended to include a semi-conducting surface.

The present invention is primarily but not exclusively directed to spraying systems adapted to be mounted on vehicles, e.g. tractors or aircraft.

Prior to mounting in the spraying apparatus, the container orifice requires to be sealed against the emission of liquid. One or more conventional sealing means may be employed, for example a cap or a metal foil seal over the orifice, or both. If desired, the container seal is adapted to be opened when, and preferably only when, located on the spraying apparatus. Such opening may take place during such location, or subsequently: furthermore, the opening may be actuated mechanically or electrically. Thus, during the action of mounting the container on to the carrier, a knife or spike on the carrier may cut or pierce a metal foil over the orifice of the container. The container orifice may be sealed by a valve, e.g. a spring-biassed ball valve which is opened during mounting by contact with a detent on the apparatus. With such a system the container orifice is automatically closed on removal from the apparatus which is particularly useful when the container still contains liquid. The same desirable end may also be accomplished by use of an electrostatic valve. Such a valve may be spring-biassed shut, and opened only by application of potential from the high voltage generator when the container is mounted in the apparatus. The electrostatic valve is particularly convenient because the container remains sealed even after being mounted in the apparatus, until the current is switched on.

Preferably means are provided for maintaining one terminal of the high voltage generator at or near earth potential. Such means may be a conductor for connection to earth, for example, a trailing earth wire dependant from the holder. Where such means are provided, it is preferred that the earthed terminal of the high voltage generator is arranged for connection to the container electrode rather than to the nozzle. Charging of the spray is then by direct contact, rather than by induction, and there is a stronger electrostatic field transporting the spray to its (earthed) target.

If desired, one of the two electrical connections between the contacts on the container and the high voltage generator terminals may be through earth; though a more direct connection is sometimes convenient.

For most efficient operation the container also requires a means of equalising the external and internal pressure during spraying, for example an air vent, or non-rigid walls.

Containers according to the invention may be filled with properly formulated spray liquid by the manufacturer, and after the containers are closed, the spray liquid will remain uncontaminated until it is actually sprayed. There is no need to clean spray-tanks to avoid contamination, so different products can be sprayed successively without undue loss of time. Toxic hazards through handling by operators are minimised; errors by field operators in mixing and dilution procedures are eliminated. After use, the containers according to the invention may be returned to the manufacturer for refilling and servicing of the high voltage generator, if required. Containers may be made from metal or from one or more elements of plastics material by, for example, injection moulding or blow moulding, or a combination of the two. The conducting elements of the containers (contacts and connections) may be provided by metal wires or inserts, or by application of conductive metallic coatings or paints to the container surface of by the use of partly-conducting plastics.

It is possible to provide the energy source for the high voltage generator in the container, but it is generally preferred to associate it with the holder, e.g. by carrying it on the vehicle carrying the holder. In a particularly convenient arrangement, the mounting means on the container has three electrical contacts; one for connecting one pole of the power source to a first input terminal of the generator; one for connecting the nozzle to a first output terminal of the generator; and one for connecting the second input and output terminals of the generator to earth.

One suitable form of power source is an electrical storage battery which may, for example, be carried on and form part of the normal mechanism of the vehicle carrying the spraying system. The amount of electrical energy required to atomise liquid is remarkably low.

A specific embodiment of the invention, comprising a container for mounting on a tractor will now be described with reference to the drawings, in which:

FIG. 1 is a vertical cross-section of a container according to the invention mounted on spraying apparatus, mounted on a tractor; it also shows the coupling connecting the sprayer to the apparatus.

FIG. 2 is a view of the coupling mouth on the line A—A of FIG. 1.

FIG. 3 is a liquid circuit diagram of the spraying system with the container mounted thereon.

FIG. 4 is an electrical circuit diagram of the spraying system with the container mounted thereon.

FIG. 5 is a vertical section through a spray nozzle.

Referring firstly to FIG. 1, the container 10 is a vessel made of rigid plastics material of 25 liter capacity, having a base 11 and a neck 12. The body of the container 10 is filled with an insecticidal formulation comprising 8% of an insecticide dissolved in a hydrocarbon solvent. In the base 11 of the container 10 is a sealed chamber 13 containing a high voltage generator 14 (20 kilovolt, 200 microamp module). The generator 14 is provided with positive and negative input terminals 15, 16 and positive and negative output terminals 17 and 18. These communicate via electrical connections 19, 20, 21, 22 with three electrical contacts 23, 24, 25 in the neck 12 of the container 13. The neck 12 comprises a cylindrical base 26 with an externally threaded portion 27. Below the threaded portion 27 is a flat annular rebate 28 on which are mounted, equally spaced, the oval metal contact studs 23, 24 and 25. From the inner edge of the annular rebate 28 a tapering nose 29 projects downwardly. The nose 29 has a projecting ridge 30 down part of one side to act as a key, but is otherwise generally annular in section.

The container 10 is connected to a coupling 31, comprising a cap 32 connected to a flexible hose 33. The mouth 34 of the cap 32 is generally annular, but is formed with an internal keyway 35 to receive the ridge 30 on the container nose 29. Three equally spaced oval electrical contact studs 36, 37, 38 are set in the mouth 34. The mouth 34 carries a collar 39 freely rotatable around it. This is internally screwthreaded at its upper end 40, and has an inwardly projecting rim 41 at its lower end abutting against a projecting lip 42 around the mouth 34. Within the cap 32 is provided a annular rubber gasket 43 for providing a liquid seal between the nose 29 and the cap 32. Below the gasket 43 is an air-bleed 44 comprising a spring-mounted ball valve 45.

Referring now to FIG. 3, the container 10 is supported on the tractor (not shown) and liquid therefrom can pass via the coupling 31 and flexible hose 33 to a tap 46, and thence, when tap 46 is open, to a spray-boom 47 comprising five electrostatic sprayheads 48. The construction of each sprayhead 48 is shown in more detail in FIG. 5. It comprises a nozzle 49 having a liquid output in the form of an annular gap between an outer hollow metal cylinder 50 and an inner solid metal cylinder 51. Around the nozzle 49, and behind the mouth of it, an annular metal electrode 52 is symmetrically disposed.

FIG. 4 shows the electrical circuit formed when the container 10 is mounted on the coupling 31. The positive pole of tractor battery 53 is connected via a switch 54 through contacts 36, 23, 18 to the positive input terminal 15 of the high voltage generator 14. The positive output terminal 17 of the generator 14 is connected via a conductor 22 and contacts 25, 38 to the spray nozzles 49. The negative pole of battery 53 is earthed via a trailing earth wire 55; so also are the negative input and output terminals 16, 18 of the generator 14, via contacts 24, 37. The annular metal electrodes 52 of the sprayheads 48 are also earthed.

To operate the spraying system, the container 10 must first be mounted on the coupling 31. For this purpose container 10 is supported neck 12 uppermost and a transport sealing cap is first unscrewed from the thread 27 of the neck 12. Cap 32 of the coupling 31 is then placed over the nose 29 of the container, ridge 30 being slotted into keyway 35, and the collar 39 screwed tightly onto thread 27. This holds the cap 32 firmly on the neck 12, a liquid-tight seal being formed between the nose 29 and the gasket 43, and good electrical connection being made between the pairs of contacts 23, 36; 24, 37 and 25, 38. Container 10 is then inverted and placed above sprayhead level in a supporting cradle (not shown) mounted on the tractor. Tap 46 is opened, permitting spray liquid to pass from the container 10 to the sprayheads 48. As liquid leaves container 10, the drop in pressure draws air into the container through air-bleed 44. The switch 54 is turned on, thereby charging the nozzles 49 to a potential of the order of 20 KV. Liquid leaving the nozzles is now broken up into small highly charged particles, as a consequence of the electrostatic field between nozzles 49 and electrodes 52, and is attracted towards the crop to be sprayed. To spray and crop evenly, the tractor is driven through the crop at a uniform speed. When the container 10 is empty, it is removed and returned to the manufacturer for testing and refilling. The apparatus described can be modified in various ways. For example, the container 10 may be provided with an electrostatic valve as described in U.S. application Ser. No. 179,438 filed Aug. 19, 1980; transport of the spray liquid through the apparatus may be assisted by an ion pump of the type described in U.S. Pat. No. 4,358,059. It is obviously possible to use more, or fewer, spray nozzles than the five illustrated in FIG. 3; for some purposes it may be convenient to use one or more linear spray nozzles of the type illustrated in U.S. Pat. No. 4,356,528 (FIGS. 12–14).

I claim:

1. A liquid container adapted to form part of apparatus for electrostatic spraying, the apparatus including a power supply, a high voltage generator, a spray nozzle at least part of the surface of which is electrically conductive, an electrode disposed adjacent the nozzle and insulated therefrom, with electrical connections for connecting the power supply to the input terminals of the generator, the electrode to one output terminal of the generator and the nozzle to the other output terminal of the generator; the container being formed so as to support and carry the generator, and having an orifice for delivering liquid, mounting means for locating the container in the apparatus in a position in which the orifice can deliver liquid to the spray nozzle, the mounting means including electrical contacts and conductors for completing said electrical connections to the generator terminals from the power supply, the nozzle and the electrode.

2. A liquid container as claimed in claim 1 in which the mounting means is provided with three electrical contacts: a first contact for connecting one pole of the power supply to a first input terminal of the generator; a second contact for connecting the nozzle to a first output terminal of the generator; and a third contact for connecting the second input and output terminals of the generator to earth.

3. Spraying apparatus suitable for receiving a container as claimed in claim 1 which includes a spray nozzle, an electrode adjacent the nozzle and insulated therefrom, complementary mounting means for locating the container in the apparatus in a position in which the orifice can deliver liquid to the spray nozzle, and a power source for activating the generator; said complementary mounting means having electrical contacts complementary to the contacts of the container mounting means, for connecting the power supply to the generator input terminals, the nozzle to one generator output terminal and the electrode to the other generator output terminal.

4. Apparatus as claimed in claim 3 which includes means for connecting the electrode to earth.

5. Apparatus as claimed in claim 3 wherein the complementary mounting means comprises three electrical contacts: a first contact for connecting one pole of the power supply to a first input terminal of the generator; a second contact for connecting the nozzle to a first output terminal of the generator; and a third contact for connecting the second input and output terminals of the generator to earth.

6. Apparatus as claimed in any of claims 3 to 5 which is mounted on a vehicle.

* * * * *